US007677276B2

(12) United States Patent
Sun

(10) Patent No.: US 7,677,276 B2
(45) Date of Patent: Mar. 16, 2010

(54) FUNNEL WITH AN ELASTIC ENGAGING OPENING

(75) Inventor: Shi Yu Sun, Shanghai (CN)

(73) Assignee: Shanghai Easy-Use Tools Enterprise Co., Ltd., Shanghai (CN)

( * ) Notice: Subject to any disclaimer, the term of this patent is extended or adjusted under 35 U.S.C. 154(b) by 0 days.

(21) Appl. No.: 12/203,178

(22) Filed: Sep. 3, 2008

(65) Prior Publication Data

US 2009/0283178 A1 Nov. 19, 2009

(30) Foreign Application Priority Data

May 13, 2008 (CN) ..... 2008 2 0058354 U

(51) Int. Cl.
*B65B 39/00* (2006.01)

(52) U.S. Cl. ..... 141/332; 141/337; 141/343; 222/567

(58) Field of Classification Search ..... 141/331–345; 222/567
See application file for complete search history.

(56) References Cited

U.S. PATENT DOCUMENTS 1,399,916 A * 12/1921 Aronson ..... 222/420
2,200,642 A * 5/1940 Shell ..... 222/51
4,811,870 A * 3/1989 Bianco ..... 222/461
5,758,804 A * 6/1998 Wirth ..... 222/460
5,857,503 A * 1/1999 Vreeken ..... 141/332
D407,643 S * 4/1999 Wirth ..... D9/447

FOREIGN PATENT DOCUMENTS

CN 200720070483.8 5/2007

* cited by examiner

*Primary Examiner*—Timothy L Maust
(74) *Attorney, Agent, or Firm*—Ming Chow; Sinorica, LLC

(57) ABSTRACT

A funnel includes a funnel body, and a narrow stem portion connected to a lower portion of the funnel body, with a half-closed damper having an elastic engaging opening being formed on a top of the funnel body. Alternatively, the funnel includes a funnel body and a narrow stem portion connected to a lower portion of the funnel body, with an elastic engaging opening and a half-opened baffle being formed at an upper portion of the funnel body at two opposite positions. In the latter case, the elastic engaging opening includes two inward curved clamping arms, and a vertical slit is formed between the two clamping arms to downward extend to the funnel body. With the elastic engaging opening, the funnel can be used with liquid containers having differently sized spouts. And, with the half-closed damper or the half-opened baffle, liquid being poured into the funnel is prevented from spilling.

14 Claims, 3 Drawing Sheets

FUNNEL WITH AN ELASTIC ENGAGING OPENING

FIELD OF THE INVENTION

The present invention relates to a funnel with an elastic engaging opening, and more particularly to a spill-prevent funnel having an elastic engaging opening and therefore being adapted to use with liquid containers having differently sized spouts while preventing liquid pouring into the funnel from spilling.

BACKGROUND OF THE INVENTION

A funnel is mainly used to guide liquid from a source into a container having a small opening. The funnel is also needed by people in many occasions in daily life, so as to effectively solve the problem of pouring a liquid. Generally, the funnel is an independent tool without being integrated into or connected to other articles. To use the funnel in pouring an amount of liquid into a container having a small opening, first insert the funnel into the small opening of the container and keep the funnel in a balanced position. Sometimes, the funnel must be troublesomely held in place with one hand, particularly when a large amount of liquid is to be distributed, so that the funnel and the containers are not tilted over. Under this circumstance, it is not easy to distribute the liquid by only one single operator. It has been tried to integrate the funnel with a barrel or bottle. However, this idea is not practical for implementation and would largely increase the cost of packaging and form a big waste of valuable resource. Therefore, it is desirable to develop a funnel that can be conveniently and quickly associated with a liquid container, from which a liquid is poured into another small-opening container.

Chinese Utility Model Patent No. ZL200720070483.8 discloses a spill-prevent funnel, which includes a funnel body, a big bottleneck support, and a small bottleneck support. The funnel body is a hollow member having a larger square top portion and a smaller round lower portion. The big bottleneck support and the small bottleneck support are separately provided on a top of the funnel body, and all have a semicircular configuration. The big and the small bottleneck support are formed at respective upper portion with two inward curved clamping arms for tightly clamping on an annular groove, which is externally formed around a neck of a liquid container. The big bottleneck support defines an enclosing radius larger than that of the small bottleneck support, and the enclosing radii of the big and the small bottleneck support must corresponding to the size of the annular grooves formed on the liquid containers. While the funnel disclosed in the above-mentioned Chinese Utility Model Patent can be associated with a liquid container and effectively prevent liquid spillage, the funnel can only be adapted to two different bottlenecks having a fixed size each, and fails to satisfy various kinds of liquid containers in the world that have differently sized container openings or spouts measured in metric units or Imperial units. Further, the aforesaid funnel is not able to prevent spillage when the liquid is poured into the funnel at a quick speed.

SUMMARY OF THE INVENTION

A primary object of the present invention is to provide a funnel with an elastic engaging opening, particularly a spill-prevent funnel having an elastic engaging opening adapted to engage with liquid container spouts of different sizes, so as to solve the problem of associating the funnel with a liquid container and overcome the disadvantage of the conventional funnel that could not be used with liquid container spouts of different sizes. For the purpose of the present invention, the liquid container means any bottles, barrels, and cans for containing a liquid product and having a projected spout. With the elastic engaging opening, the funnel of the present invention can be firmly engaged with different liquid container spouts having a diameter ranged from one time to one and a half times of a nominal diameter of the spout, and ensure effective pouring of liquid from the container into the funnel without spilling.

According to an embodiment of the present invention, the funnel with an elastic engaging opening includes a funnel body 2 and a narrow stem portion 3 connected to a lower portion of the funnel body 2, and a half-closed damper 1 having an elastic engaging opening 6 is formed on a top of the funnel body 2.

In a preferred embodiment of the present invention, the funnel body 2 and the damper 1 is integrally formed into one unit, and a slit 5 is formed between the funnel body 2 and the damper 1 to extend across one side of the damper 1 formed with the elastic engaging opening 6 and two other sides adjacent to the elastic engaging opening 6. The damper 1 has a half-closed structure, a rear portion of which has a cross sectional shape substantially the same as that of the funnel body 2, enabling easy production of the funnel. A front portion of the damper 1 is open to form the elastic engaging opening 6 for engaging the funnel with a spout on a liquid container. Due to the slit 5 that partially separates the damper 1 from the funnel body 2, the open side of the half-closed damper 1 forming the engaging opening actually includes two suspended thin walls allowing elastic deformation thereof. Therefore, the engaging opening can be elastically expanded within a desired range.

In the aforesaid funnel with an elastic engaging opening, the damper 1 is provided along an upper open end thereof with an outward protruded reinforcing edge 8, and holes 12 can be formed on the two sides adjacent to and perpendicular to the elastic engaging opening. When the structural strength is not a problem, a plurality of differently sized and/or differently shaped holes can be formed on each of the two sides of the damper 1 adjacent to the elastic engaging opening 6 to give the funnel an esthetic appearance while reduce the material needed to produce the funnel.

According to another embodiment of the present invention, the funnel with an elastic engaging opening includes a funnel body 2 and a narrow stem portion 3 connected to a lower portion of the funnel body 2, and an elastic engaging opening 6 and a half-opened baffle 11 are oppositely formed on an upper portion of the funnel body 2. In this embodiment, the elastic engaging opening 6 includes two inward extended clamping arms 9, each of which is an elongated and inward curved arm strong enough to withstand elastic deformation within a relatively small range. To enable easy engagement of the elastic engaging opening 6 of the funnel with a spout projected from a liquid container, a slit 10 is formed between the two clamping arms 9 to vertically downward extend to the funnel body 2. With the vertical slit 10, the funnel body 2 and the elastic engaging opening 6 as a whole is elastically deformable. Of course, under the same use conditions, the elastic engaging opening 6 having the above-described structure in this embodiment provides elasticity slightly smaller than that can be provided by the elastic engaging opening 6 in the first embodiment. The half-opened baffle 11 is located opposite to the elastic engaging opening 6, and has two lateral sides properly extended toward the elastic engaging opening 6. The half-opened baffle 11 has a height substantially equal to that of the elastic engaging opening 6, and is mainly used to prevent the liquid from spilling when being poured into the funnel.

In the aforesaid funnel having an elastic engaging opening, the vertical slit 10 extended to the funnel body is a straight slit. The slit 10 can be otherwise a saw-toothed slit or a wavy slit. The longer the vertical slit 10 is extended to the funnel body, the higher the elasticity of the elastic engaging opening 6 is. However, an excessively long vertical slit 10 tends to cause liquid spillage from the funnel.

The elastic engaging opening 6 in the embodiments of the present invention is divided into a left and a right part. Inner edges of the left and the right part of the elastic engaging opening 6 are faced toward each other, and each define an inward curved recess 7. A symmetric center of the two curved recesses 7 is unchanged in position and is consistent with a centerline of the narrow stem portion 3 even when the elastic engaging opening 6 is elastically expanded. Therefore, liquid being poured into the funnel can smoothly flow into and through the narrow stem portion 3. When the elastic engaging opening 6 has symmetric left and right parts, the symmetric center of the two curved recesses 7 would always be consistent with a symmetric centerline of the funnel having the elastic engaging opening. This in turn ensures the consistency of the symmetric center of the two curved recesses 7 with the centerline of the narrow stem portion 3. In the present invention, the elasticity of the elastic engaging opening on the funnel either comes from the elastic deformability of the whole or part of the funnel, or comes from an elastic property or an elastic structure of the engaging opening itself.

The funnel body 2 is a geometrical body having a closed peripheral wall internally defining a hollow space having an upper and a lower open end. The funnel body 2 has a larger upper cross section and a smaller lower cross section. The upper cross section can be a polygonal, a round, or an oblong shape, or any combination thereof; and the lower cross section can be a round or an axially symmetric polygonal shape. Generally, the upper cross section of the funnel body 2 has a regular polygonal or a round shape, but can usually be defined by a straight line and a curve, too. In consideration of good connection of the funnel body 2 to the narrow stem portion 3, the lower cross section of the funnel body 2 is basically the same as that of the narrow stem portion 3. When necessary, a transition section can be provided between the funnel body 2 and the narrow stem portion 3.

In a preferred embodiment of the present invention, the funnel body 2 is a geometrical body having a closed peripheral wall internally defining a hollow space having an upper and a lower open end. The funnel body 2 can have a square upper cross section and a round lower cross section. In most cases, a geometrical body having a round top and a square bottom is esthetic and widely employed in design. This round-top and square-bottom geometrical body is inverted and used for the funnel in the preferred embodiment of the present invention to reasonably show the same esthetics.

In the funnel with an elastic engaging opening according to the present invention, an anti-slipping means is externally provided around a lower open end of the narrow stem portion 3 mainly for ensuring a reliable connection of an external tubular member to the funnel.

In an embodiment of the present invention, the anti-slipping means is an outward protruded annular flange 4 formed along the lower open end of the narrow stem portion 3. When the external tubular member has been connected to the flange 4, a stop ring can be further mounted on the tubular member above the flange 4, so that the tubular member is held in place without the risk of sliding off the narrow stem portion 3.

The funnel with an elastic engaging opening according to the present invention provides at least the following advantages:

1. It is reasonably constructed based on a complete and smart design.
2. One funnel of a fixed specification can be used with a plurality of liquid containers having differently sized spouts, no matter the spouts are designed and measured in metric units or imperial units.
3. The elastic engaging opening ensures firm and reliable connection of the funnel to a liquid container to effectively prevent liquid from spilling when being poured from the liquid container into the funnel.
4. The funnel with the elastic engaging opening is easy and convenient to use. A user needs only to align the engaging opening with the spout, and the funnel can be lightly pushed to associate with the liquid container; or to apply a pull force to disengage the funnel from the liquid container.
5. The anti-slipping device provided along the lower open end of the narrow stem portion ensures reliable connection of the external tubular member to the funnel and prevents the tubular member from sliding off the funnel.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
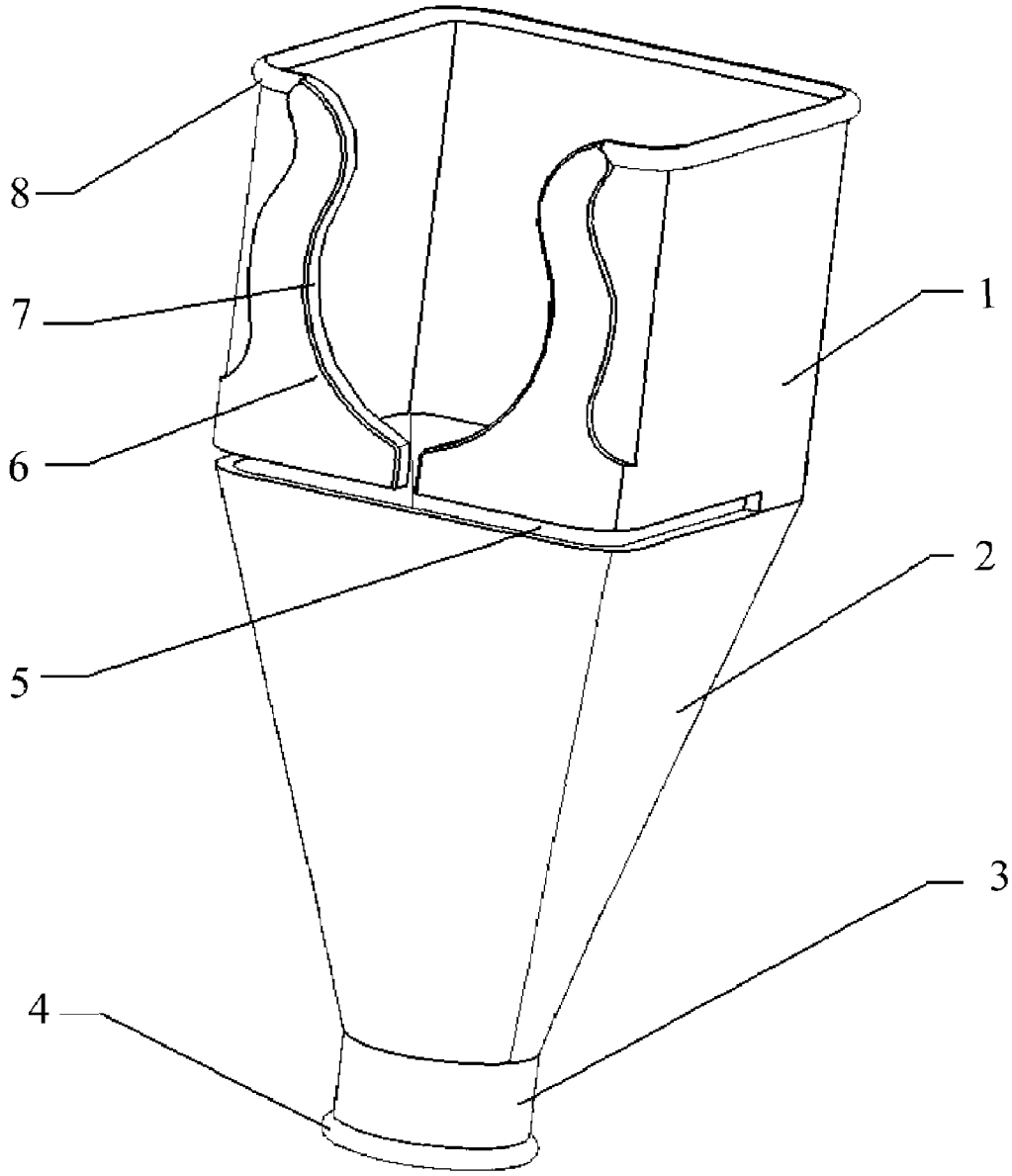
FIG. 1 is a perspective view of a funnel with an elastic engaging opening according to a first embodiment of the present invention.

The present invention will now be described with some preferred embodiments thereof. For the purpose of easy to understand, elements that are the same in the preferred embodiments are denoted by the same reference numerals.

Please refer to FIG. 1. A funnel with an elastic engaging opening according to a first embodiment of the present invention includes a funnel body 2 and a narrow stem portion 3 connected to a lower portion of the funnel body 2, and a half-closed damper 1 having an elastic engaging opening 6 formed on one side thereof is provided on a top of the funnel body 2. The funnel body 2 and the damper 1 are integrally formed into one unit with a narrow slit 5 formed between the funnel body 2 and the damper 1 to extend across the side with the elastic engaging opening 6 and two other sides adjacent to the elastic engaging opening 6. The damper 1 has a half-closed structure, a rear portion of which has a cross sectional shape substantially the same as that of the funnel body 2, so as to enable easy production of the funnel. A front portion of the damper 1 is open to form the elastic engaging opening 6. The clamper 1 is provided along an upper open end thereof with an outward protruded reinforcing edge 8.

Figure 2:
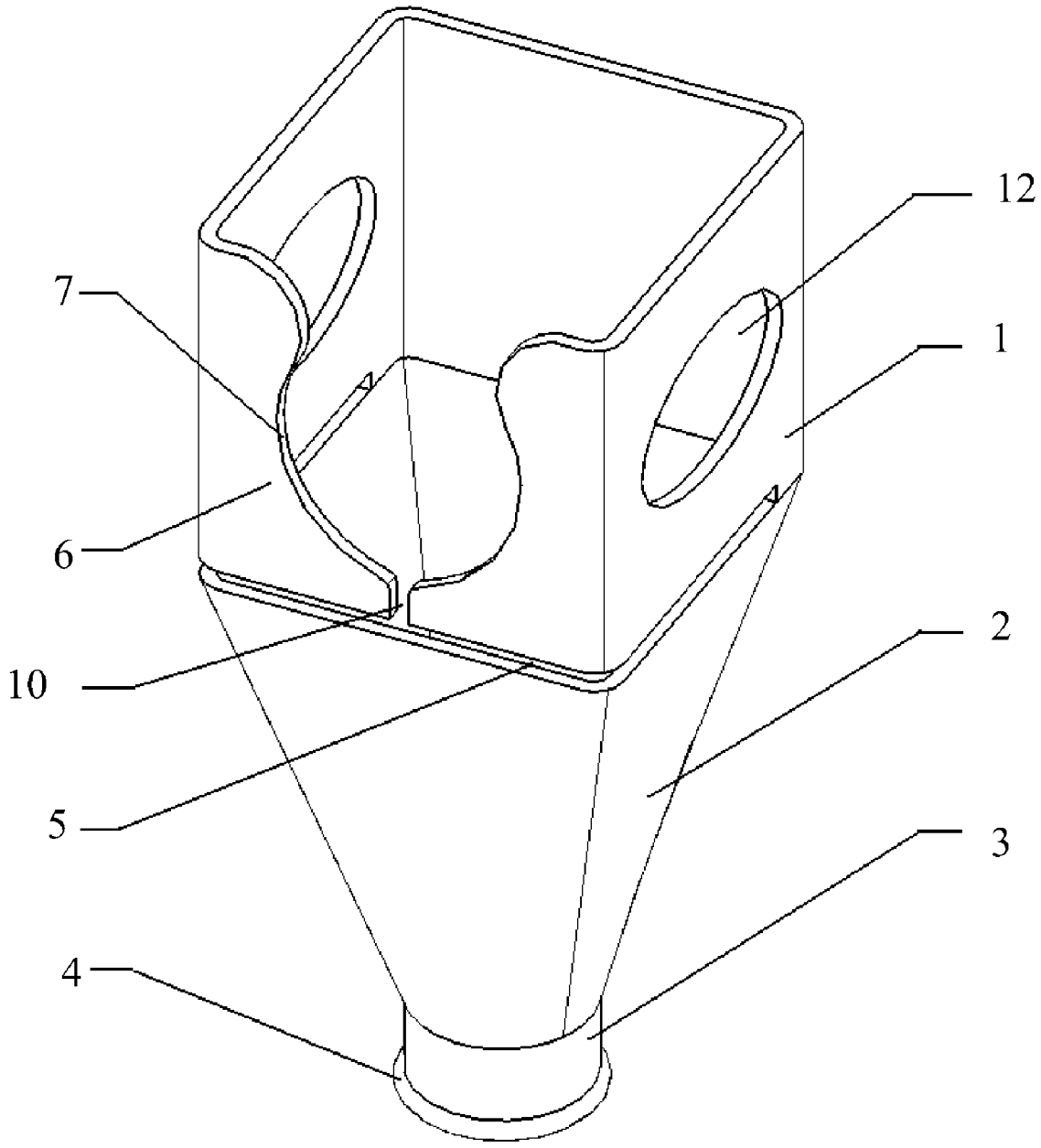
FIG. 2 is a perspective view of a funnel with an elastic engaging opening according to the present invention, in which holes are provided on sidewalls of the funnel adjacent to the elastic engaging opening.

FIG. 2 shows the damper 1 in the first embodiment is further provided on the two sides adjacent to and perpendicular to the elastic engaging opening 6 with one or more holes 12 each. The forming of the holes 12 not only gives the whole funnel an esthetic appearance, but also enables the funnel to be produced with reduced material.

As can be seen from FIGS. 1 and 2, the elastic engaging opening 6 is divided into a left and a right part. Inner edges of the left and the right part of the elastic engaging opening 6 are faced toward each other, and each define an inward curved recess 7. A symmetric center of the two curved recesses 7 is unchanged in position and is consistent with a centerline of the narrow stem portion 3 even when the elastic engaging opening 6 is elastically expanded. Therefore, liquid being poured into the funnel can smoothly flow into and through the narrow stem portion 3. When the elastic engaging opening 6 has symmetric left and right parts, the symmetric center of the two curved recesses 7 would always be consistent with a symmetric centerline of the funnel with an elastic engaging opening. This in turn ensures the consistency of the symmetric center of the two curved recesses 7 with the centerline of the narrow stem portion 3. The funnel body 2 is a geometrical body having a closed peripheral wall internally defining a hollow space having an upper and a lower open end. The funnel body 2 has a larger and square upper cross section and a smaller and round lower cross section. In most cases, a geometrical body having a round top and a square bottom is esthetic and widely employed in design. In the present invention, the round-top and square-bottom geometrical body is inverted and used in the preferred embodiments of the present invention to reasonably show the same esthetics. An outward protruded annular flange 4 is formed along a lower open end of the narrow stem portion 3 to serve as an anti-slipping means, so as to ensure that an external tubular member can be reliably connected to the funnel. When the external tubular member has been connected to the funnel at the flange 4, a stop ring can be further mounted on the tubular member above the flange 4, so that the tubular member is held in place without the risk of sliding off the narrow stem portion 3.

Figure 3:
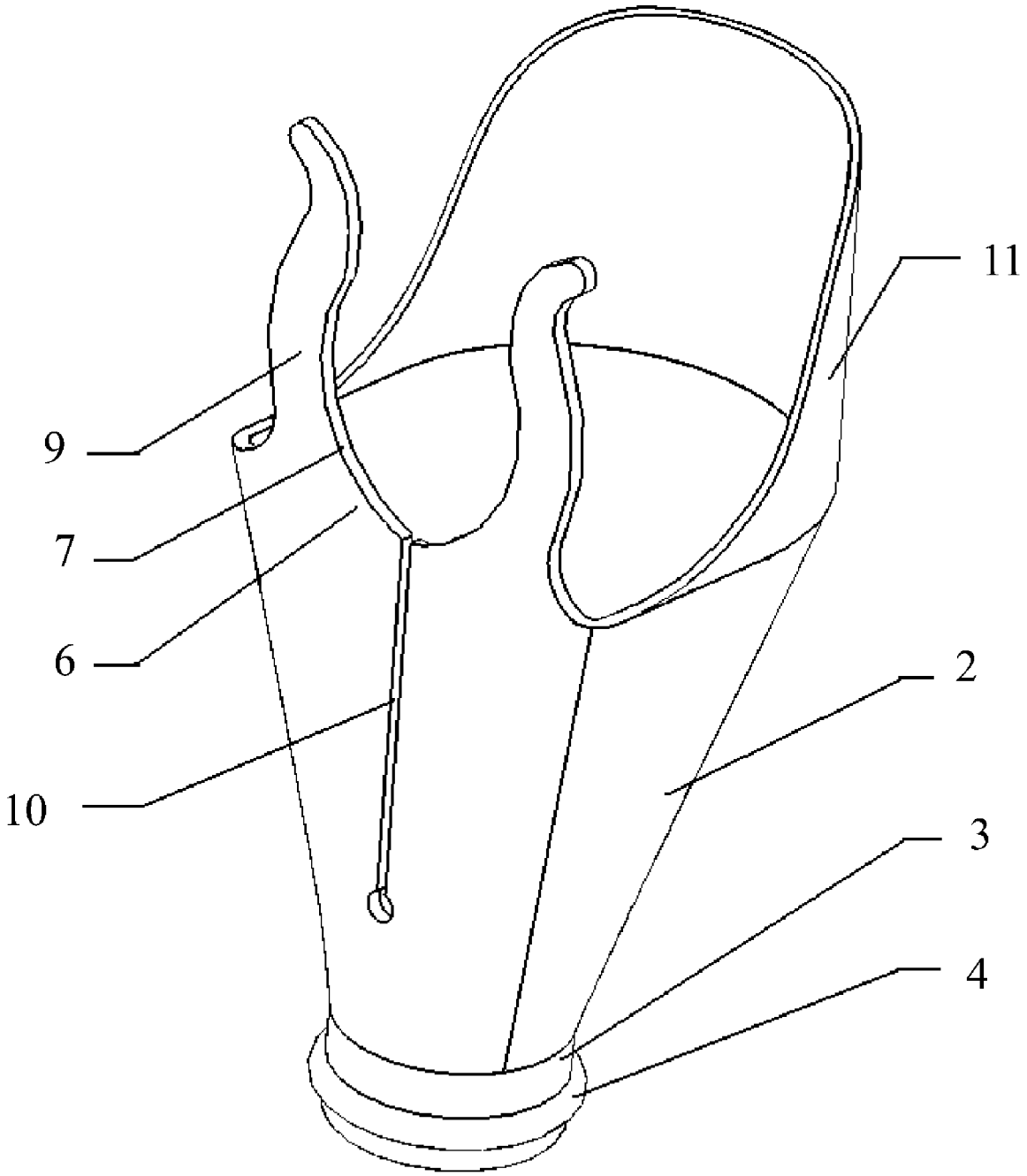
FIG. 3 is a perspective view of the funnel with an elastic engaging opening according to a second embodiment of the present invention.

FIG. 3 shows a funnel with an elastic engaging opening according to a second embodiment of the present invention. The funnel in the second embodiment includes a funnel body 2 and a narrow stem portion 3 connected to a lower portion of the funnel body 2, and an upper portion of the funnel body 2 is formed into an elastic engaging opening 6 and a half-opened baffle 11 located opposite to the elastic engaging opening 6. The elastic engaging opening 6 includes two inward extended clamping arms 9, each of which is an elongated and inward curved arm strong enough to withstand elastic deformation within a relatively small range. To enable easy engagement of the elastic engaging opening 6 of the funnel with a spout projected from a liquid container, a straight slit 10 is formed between the two clamping arms 9 to vertically downward extend to the funnel body 2. With the straight slit 10, the funnel body 2 and the elastic engaging opening 6 as a whole is elastically deformable. The half-opened baffle 11 is located opposite to the elastic engaging opening 6, and has two lateral sides properly extended toward the elastic engaging opening 6. The half-opened baffle 11 has a height substantially equal to that of the elastic engaging opening 6, and is mainly used to prevent the liquid from spilling when being poured into the funnel. The elastic engaging opening 6 is divided into a left and a right part. Inner edges of the left and the right part of the elastic engaging opening 6 are faced toward each other, and each define an inward curved recess 7. A symmetric center of the two curved recesses 7 is unchanged in position and is consistent with a centerline of the narrow stem portion 3 even when the elastic engaging opening 6 is elastically expanded. Therefore, liquid being poured into the funnel can smoothly flow into and through the narrow stem portion 3. When the elastic engaging opening 6 has symmetric left and right parts, the symmetric center of the two curved recesses 7 would always be consistent with a symmetric centerline of the funnel having an elastic engaging opening. This in turn ensures the consistency of the symmetric center of the two curved recesses 7 with the centerline of the narrow stem portion 3. An outward protruded annular flange 4 is formed along a lower open end of the narrow stem portion 3 to serve as an anti-slipping ring, so as to ensure that an external tubular member can be reliably connected to the funnel at the flange 4. When the external tubular member has been connected to the flange 4, a stop ring can be further mounted on the tubular member above the flange 4, so that the tubular member is held in place without the risk of sliding off the narrow stem portion 3.

Experiments prove the present invention provides an effective way to stably engage a funnel with a liquid container, and solves the problem in the prior art of being failed to adapt one funnel to many liquid containers having differently sized spouts

What is claimed is:

1. A funnel with elastic engaging opening, comprising a funnel body and a narrow stem portion connected to a lower portion of the funnel body; the funnel is characterized in that a halt-closed clamper having an elastic engaging opening disposed thereon is provided on a top of the funnel body;

wherein the funnel body and the clamper are integrally formed into one unit with a narrow slit formed between the funnel body and the clamper to extend across a side of the elastic engaging opening and two other sides adjacent thereto.

2. The funnel with elastic engaging opening as claimed in claim 1, wherein the clamper is provided along an upper open end thereof with an outward protruded reinforcing edge, and provided on two sides adjacent to and perpendicular to the elastic engaging opening with at least one hole.

3. The funnel with elastic engaging opening as claimed in claim 1, wherein the elastic engaging opening is divided into a left part and a right part; inner edges of the left part and the right part being faced toward each other, and each defining an inward curved recess; and a symmetric center of the two curved recesses being unchanged in position and being consistent with a centerline of the narrow stem portion even while the elastic engaging opening is elastically expanded.

4. The funnel with elastic engaging opening as claimed in claim 1, wherein the funnel body is a geometrical body having a closed peripheral wall internally defining a hollow space having an upper and a lower open end, and having a larger upper cross section and a smaller lower cross section; the upper cross section of the funnel body having a shape selected from the group consisting of a polygonal shape, a round shape, an oblong shape, and combinations thereof; and the lower cross section of the funnel body having a shape selected from the group consisting of a round shape and an axially symmetric polygonal shape.

5. The funnel with elastic engaging opening as claimed in claim 4, wherein the upper cross section of the funnel body has a rectangular shape, and the lower cross section of the funnel body has a round shape.

6. The funnel with elastic engaging opening as claimed in claim 1, wherein the narrow stem portion is externally formed along a lower open end thereof with anti-slipping means.

7. The funnel with elastic engaging opening as claimed in claim 6, wherein the anti-slipping means is at least one outward protruded annular flange formed along the lower open end of the narrow stem portion.

8. A funnel with elastic engaging opening, comprising a funnel body and a narrow stem portion connected to a lower portion of the funnel body; the funnel is characterized in that an upper portion of the funnel body is formed into an elastic engaging opening and a half-opened baffle located opposite to the elastic engaging opening; the elastic engaging opening including two inward extended clamping arms, and a vertical slit formed therebetween extending to the funnel body.

9. The funnel with elastic engaging opening as claimed in claim 8, wherein the vertical slit extending to the funnel body is a straight slit.

10. The funnel with elastic engaging opening as claimed in claim 8, wherein the elastic engaging opening is divided into a left part and a right part; inner edges of the left part and the right part being faced toward each other, and each defining an inward curved recess; and a symmetric center of the two curved recesses being unchanged in position and being consistent with a centerline of the narrow stem portion even while the elastic engaging opening is elastically expanded.

11. The funnel with elastic engaging opening as claimed in claim 8, wherein the funnel body is a geometrical body having a closed peripheral wall internally defining a hollow space having an upper and a lower open end, and having a larger upper cross section and a smaller lower cross section; the upper cross section of the funnel body having a shape selected from the group consisting of a polygonal shape, a round shape, an oblong shape, and combinations thereof; and the lower cross section of the funnel body having a shape selected from the group consisting of a round shape and an axially symmetric polygonal shape.

12. The funnel with elastic engaging opening as claimed in claim 11, wherein the upper cross section of the funnel body has a rectangular shape, and the lower cross section of the funnel body has a round shape.

13. The funnel with elastic engaging opening as claimed in claim 8, wherein the narrow stem portion is externally formed along a lower open end thereof with anti-slipping means.

14. The funnel with elastic engaging opening as claimed in claim 13, wherein the anti-slipping means is at least one outward protruded annular flange formed along the lower open end of the narrow stem portion.

* * * * *